US006543883B1

(12) United States Patent
Dodd et al.

(10) Patent No.: US 6,543,883 B1
(45) Date of Patent: Apr. 8, 2003

(54) FLUID EJECTION DEVICE WITH DRIVE CIRCUITRY PROXIMATE TO HEATING ELEMENT

(75) Inventors: Simon Dodd, Corvallis, OR (US); Joseph M Torgerson, Philomath, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/967,665

(22) Filed: Sep. 29, 2001

(51) Int. Cl.[7] ..... B41J 2/05
(52) U.S. Cl. ..... 347/58; 347/59
(58) Field of Search ..... 347/57–59, 50, 347/63, 65, 67, 20, 56, 61

(56) References Cited

U.S. PATENT DOCUMENTS

| | | | | |
|---|---|---|---|---|
| 4,429,321 A | * | 1/1984 | Matsumoto | 347/59 |
| 5,182,577 A | | 1/1993 | Ishinaga et al. | 346/140 |
| 5,563,642 A | | 10/1996 | Keefe et al. | 347/84 |
| 5,568,171 A | | 10/1996 | Keefe et al. | 347/58 |
| 5,594,481 A | | 1/1997 | Keefe et al. | 347/65 |
| 5,604,519 A | | 2/1997 | Keefe et al. | 347/13 |
| 5,619,236 A | | 4/1997 | Keefe et al. | 347/84 |
| 5,635,968 A | * | 6/1997 | Bhaskar et al. | 347/59 |
| 5,638,101 A | | 6/1997 | Keefe et al. | 347/65 |
| 5,648,804 A | | 7/1997 | Keefe et al. | 347/47 |
| 5,648,805 A | | 7/1997 | Keefe et al. | 347/65 |
| 5,648,806 A | | 7/1997 | Steinfield et al. | 347/87 |
| 5,774,147 A | | 6/1998 | Saito et al. | 347/59 |
| 5,874,974 A | | 2/1999 | Courian et al. | 347/65 |
| 5,946,012 A | | 8/1999 | Courian et al. | 347/63 |
| 5,984,464 A | | 11/1999 | Steinfield et al. | 347/87 |
| 6,111,291 A | | 8/2000 | Giebel | 257/339 |
| 6,183,078 B1 | | 2/2001 | Pietrzyk et al. | 347/92 |
| 6,286,924 B1 | | 9/2001 | Ahne et al. | 347/10 |
| 6,309,053 B1 | | 10/2001 | Torgerson et al. | 347/59 |

FOREIGN PATENT DOCUMENTS

| | | | |
|---|---|---|---|
| EP | 0769379 B1 | 4/1997 | B41J/2/16 |
| EP | 0816082 A2 | 1/1998 | B41J/2/05 |
| EP | 1215047 A2 | 6/2002 | |

OTHER PUBLICATIONS

PCT International Search Report, PCT/US 01/02601, May 30, 2001.
Application No. 09/883398, Filed Jun. 19, 2001; Joseph M. Torgerson, et al. (39pages).

* cited by examiner

*Primary Examiner*—Raquel Yvette Gordon
*Assistant Examiner*—Juanita Stephens
(74) *Attorney, Agent, or Firm*—Lucinda G. Price

(57) ABSTRACT

A fluid ejection device includes drive circuitry for a heating element, wherein at least part of the drive circuitry is positioned proximate to and within 60 microns of the heating element.

20 Claims, 8 Drawing Sheets

FLUID EJECTION DEVICE WITH DRIVE CIRCUITRY PROXIMATE TO HEATING ELEMENT

FIELD OF THE INVENTION

The present invention relates to fluid ejection devices and, more particularly, to proximate positioning of drive circuitry with respect to heating elements of fluid ejection devices.

BACKGROUND OF THE INVENTION

In a printhead of an ink jet printer, a drive bubble is formed with heated fluid or ink that causes a droplet of fluid to be ejected from a nozzle or orifice of a printhead towards the media. The fluid is heated by resistors that are activated in response to associated transistors. The resistors and transistors are often formed over a silicon substrate.

In some MOS transistors that may be used to fire a resistor, polycrystalline silicon, also known as polysilicon, is layered over the thermal isolation underlayer and is used as a high resistance, not quite insulating, conductor that acts as the gate of the transistor. When current is passed through the transistor gate, an electric field is established which "opens" the flow of electrons between the source and the drain of the transistor, establishing a circuit. When current is turned off to the transistor gate, the electron flow stops, turning off the transistor.

A very thin thermal isolation underlayer, for example a silicon oxide layer, is often applied to the silicon substrate of the printhead, lying between the heating resistors and the silicon substrate. The underlayer protects the silicon substrate during the firing pulse of the resistor. Because the thermal isolation underlayer is often very thin, an electric field generated by the gate can influence the movement of the electrons in the transistor.

Often, the drive transistors have been located a distance from the resistors to protect the transistors from being exposed frequently to high heat, and thus shortening the operating lives of the transistors. Another reason for the distance between the transistors and resistors may be to minimize the mechanical pounding of the drive transistors by the explosions of the fluid bubbles when the fluid is heated.

DISCLOSURE OF THE INVENTION

A fluid ejection device or printhead, and a method of forming such devices, are described. In one embodiment, the printhead includes a firing chamber from which heated fluid is ejected. The printhead also includes a resistor that heats fluid in the firing chamber, the resistor formed in a substrate underlying the firing chamber. The printhead further includes a transistor electrically coupled with the resistor, the transistor also formed in the substrate. The transistor is positioned proximate to the resistor and at a distance within 60 microns thereof. The substrate has a width that corresponds to the distance between the resistor and the transistor.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION

Figure 1:
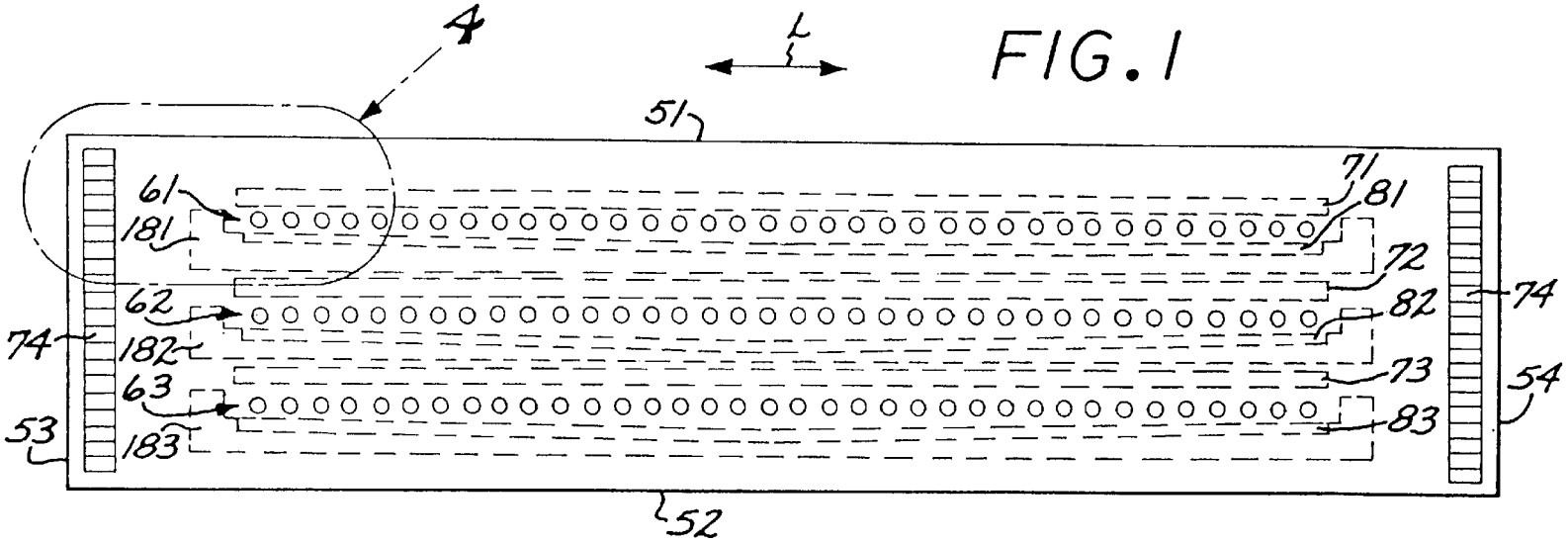
FIG. 1 is an unscaled schematic top plan view illustration of the layout of an ink jet printhead that employs an embodiment of the present invention.

In the following detailed description and in the several figures of the drawing, like elements are identified with like reference numerals.

Figure 2:
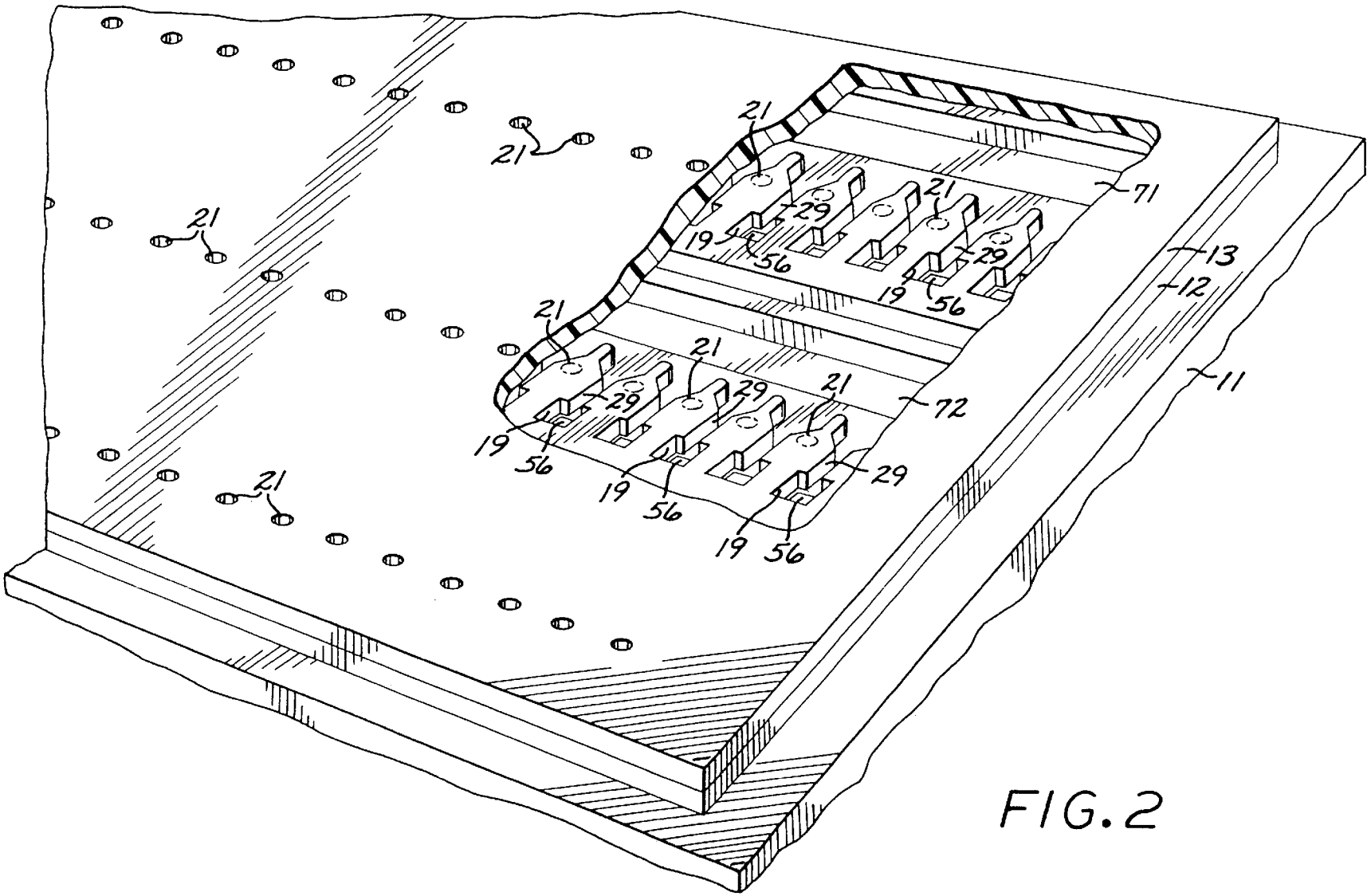
FIG. 2 is a schematic, partially broken away perspective view of the ink jet printhead of FIG. 1.

Referring now to FIGS. 1 and 2, schematically illustrated therein is an unscaled schematic perspective view of an ink jet printhead (or fluid ejection device or replaceable printer component) in which the invention can be employed and which generally includes (a) a thin film substructure or die 11 comprising a substrate such as silicon and having various thin film layers formed thereon, (b) an ink barrier layer 12 disposed on the thin film substructure 11, and (c) an orifice or nozzle plate 13 laminarly attached to the top of the ink barrier 12.

The thin film substructure 11 is formed pursuant to conventional integrated circuit techniques, and includes thin film heater resistors 56 formed therein. The ink barrier layer 12 is formed of a dry film that is heat and pressure laminated to the thin film substructure 11 and photo defined to form therein ink chambers 19 and ink channels 29 which are disposed over resistor regions in which the heater resistors are formed. Gold bonding pads 74 engagable for external electrical connections are disposed at longitudinally spaced apart, opposite ends of the thin film substructure 11 and are not covered by the ink barrier layer 12. By way of illustrative example, the barrier layer material comprises an acrylate based photopolymer dry film such as the "Parad" brand photopolymer dry film obtainable from E.I. duPont de Nemours and Company of Wilmington, Del. Similar dry films include other duPont products such as the "Riston" brand dry film and dry films made by other chemical providers. The orifice plate 13 comprises, for example, a planar substrate comprised of a polymer material and in which the orifices are formed by laser ablation, for example as disclosed in commonly assigned U.S. Pat. No. 5,469,199, incorporated herein by reference. The orifice plate can also comprise a plated metal such as nickel.

Figure 3:
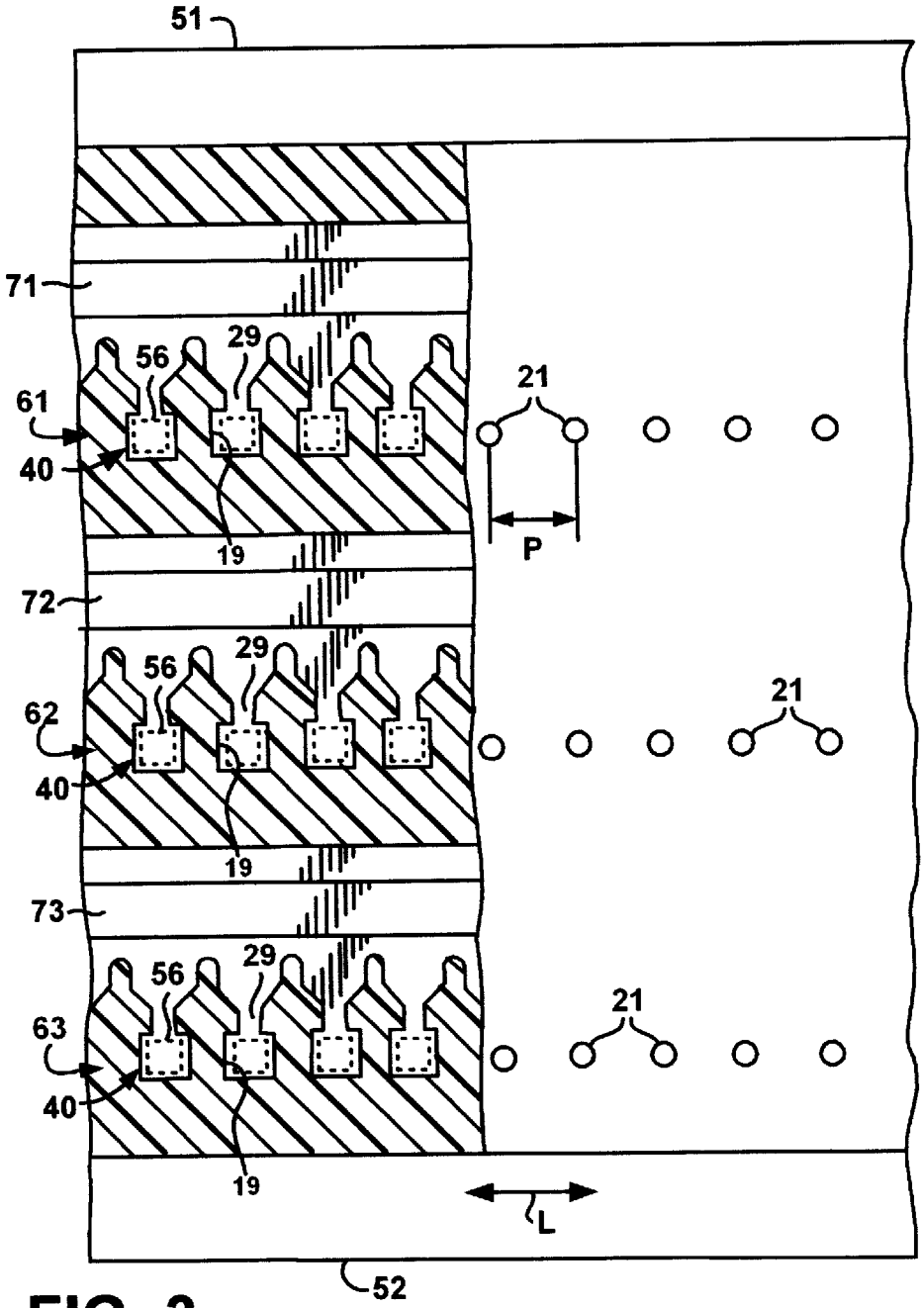
FIG. 3 is an unscaled schematic partial top plan illustration of the ink jet printhead of FIG. 1.

As depicted in FIG. 3, the ink chambers 19 in the ink barrier layer 12 are more particularly disposed over respective ink firing resistors 56, and each ink chamber 19 is defined by interconnected edges or walls of a chamber opening formed in the barrier layer 12. The ink channels 29 are defined by further openings formed in the barrier layer 12, and are integrally joined to respective ink or fluid firing chambers 19. FIGS. 1, 2 and 3 illustrate by way of example a slot fed ink jet printhead wherein the ink channels open towards an edge formed by an ink feed slot in the thin film substructure, whereby the edge of the ink feed slot forms a feed edge.

The orifice plate 13 includes orifices or nozzles 21 disposed over respective ink chambers 19, such that each ink firing resistor 56, an associated ink chamber 19, and an associated orifice 21 are aligned and form an ink drop generator 40.

While the disclosed printhead has been described as having a barrier layer and a separate orifice plate, it should be appreciated that the invention can be implemented in printheads having an integral barrier/orifice structure that can be made using a single photopolymer layer that is exposed with a multiple exposure process and then developed.

The ink drop generators 40 are arranged in three columnar arrays or groups 61, 62, 63 that are spaced apart from each other transversely relative to a reference axis L. The heater resistors 56 of each ink drop generator group are generally aligned with the reference axis L and have a predetermined center to center spacing or nozzle pitch P along the reference axis L. By way of illustrative example, the thin film substructure is rectangular and opposite edges 51, 52 thereof are longitudinal edges of the length dimension while longitudinally spaced apart, opposite edges 53, 54 are of the width dimension which is less than the length dimension of the printhead. The longitudinal extent of the thin film substructure is along the edges 51, 52 which can be parallel to the reference axis L. In use, the reference axis L can be aligned with what is generally referred to as the media advance axis.

While the ink drop generators 40 of each ink drop generator group are illustrated as being substantially collinear, it should be appreciated that some of the ink drop generators 40 of an ink drop generator group can be slightly off the center line of the column, for example to compensate for firing delays.

Insofar as each of the ink drop generators 40 includes a heater resistor 56, the heater resistors are accordingly arranged in groups or arrays that correspond to the ink drop generators. For convenience, the heater resistor arrays or groups will be referred to by the same reference numbers 61, 62, 63.

The thin film substructure 11 of the printhead of FIGS. 1, 2 and 3 more particularly includes ink feed slots 71, 72, 73 that are aligned with the reference axis L, and are spaced apart from each other transversely relative to a reference axis L. The ink feed slots 71, 72, 73 respectively feed the ink drop generator groups 61, 62, 63, and by way of illustrative example are located on the same side of the ink drop generator groups that they respectively feed. By way of illustrative example, each of the ink feed slots provides ink of a different color, such as cyan, yellow and magenta.

The thin film substructure 11 further includes drive transistor circuit arrays 81, 82, 83 formed in the thin film substructure 11 and located adjacent respective ink drop generator groups (61, 62, 63). Each drive circuit array (81, 82, 83) includes a plurality of FET drive circuits 85 connected to respective heater resistors 56. Associated with each drive circuit array (81, 82, 83) is a ground bus (181, 182, 183) to which the source terminals of all of the FET drive circuits 85 of the adjacent drive circuit array (81, 82, 83) are electrically connected. Each ground bus (181, 182, 183) is electrically interconnected to at least one bond pad 74 at one end of the printhead structure and to at least one contact pad 74 at the other end of the printhead structure.

Figure 5:
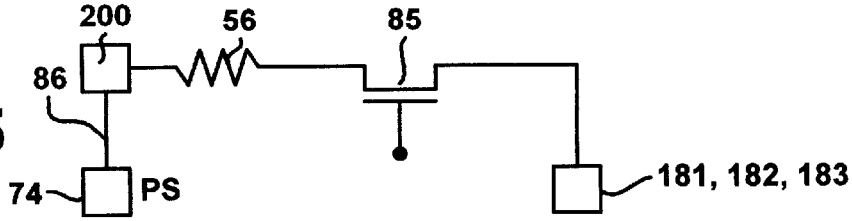
FIG. 5 is an electrical circuit schematic depicting the electrical connections of a heater resistor and an FET drive circuit of the printhead of FIG. 1.

As schematically shown in FIG. 5, the drain terminal of each FET circuit 85 is electrically connected to one terminal of the adjacent heater resistor 56 which receives at its other terminal an appropriate ink firing primitive select signal PS via a conductive trace 86 that is routed to a contact pad 74 at one end of the printhead structure. The conductive traces 86 comprise, for example, traces in a gold metallization layer 202 (FIG. 6) that would be above and dielectrically separated from the metallization layer in which the ground busses 181, 182, 183 are formed. The conductive traces 86 are electrically connected to the heater resistors 56 by conductive vias 200 and metal traces 57 (FIG. 6) formed in the same metallization layer as the ground busses 181, 182, 183. Also, the conductive trace 86 for a particular heater resistor can be generally routed to a bond pad 74 on the end that is closest to that heater resistor. Conductive via 200, as shown in FIG. 5, is the contact between the gold metallization layer 202 and the metal traces 57. In one embodiment, print commands are sent through electrical signals to the drive circuitry 85 of an associated heating resistor 56. The heating resistor is fired and heated fluid is ejected from the firing chamber in response to the printing command.

Figure 4:
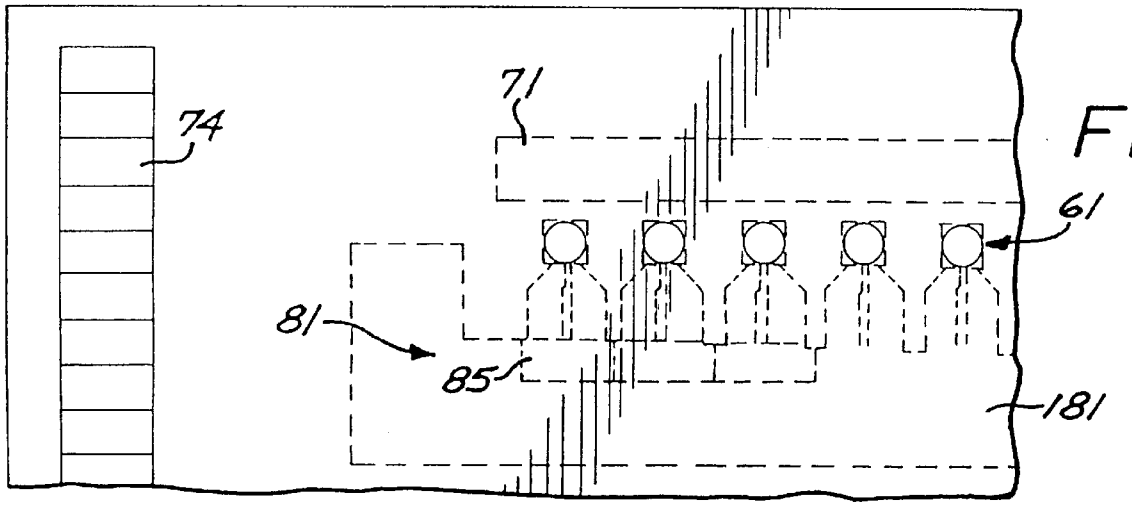
FIG. 4 is a partial top plan view generally illustrating a first embodiment of the layout of an FET drive circuit array and an associated ground bus taken from section 4 of the printhead of FIG. 1.
Figure 4A:
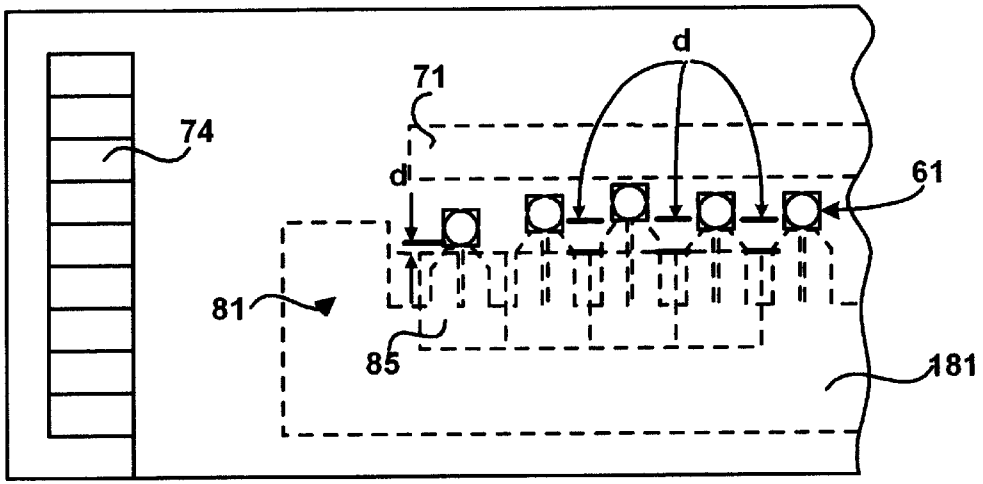
FIG. 4A is a partial top plan view generally illustrating a second embodiment of the layout of an FET drive circuit array and an associated ground bus taken from section 4 of the printhead of FIG. 1.
Figure 6:
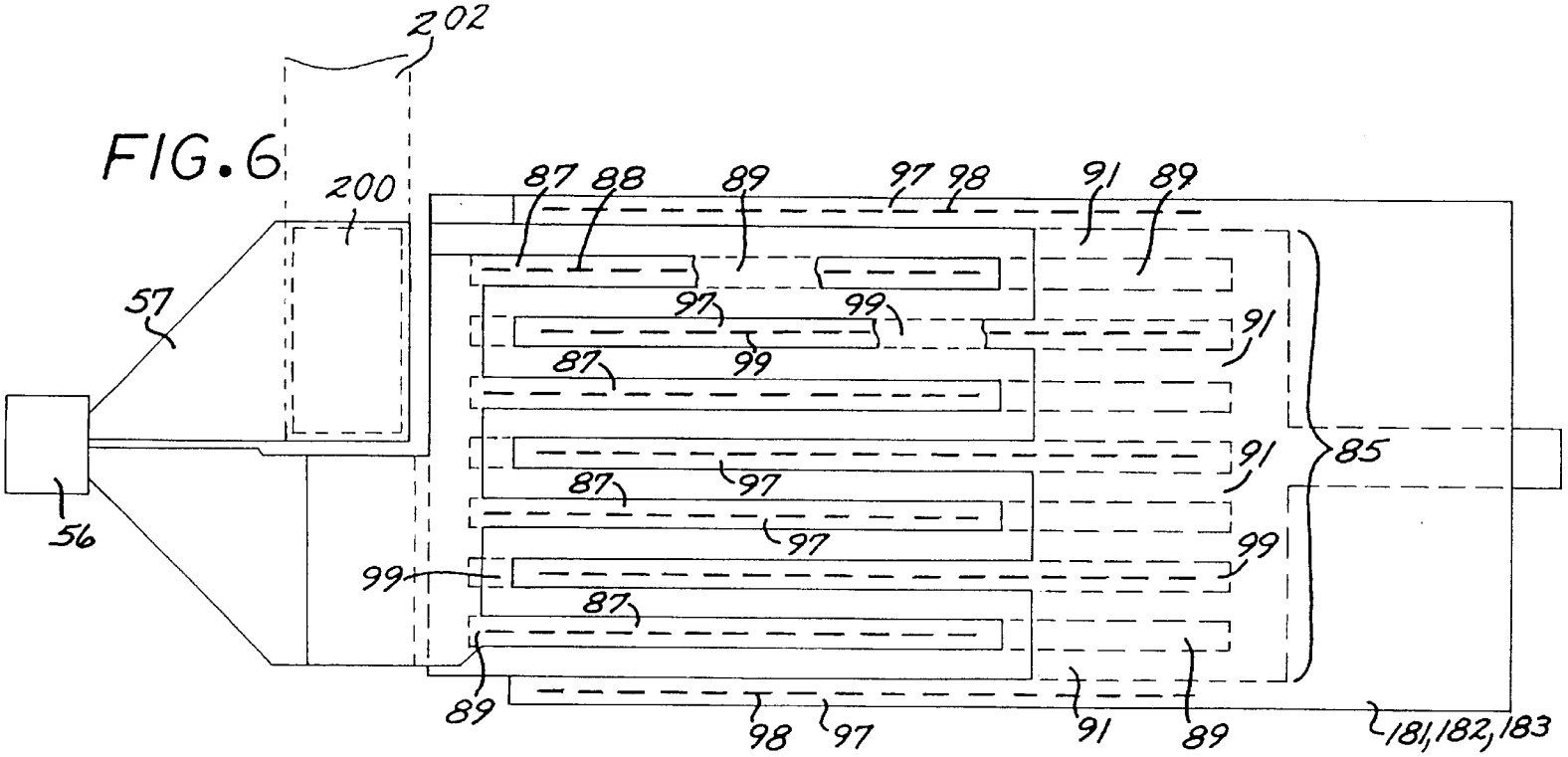
FIG. 6 is a plan view of representative FET drive circuits and the associated ground bus of the first embodiment of the printhead of FIG. 1.
Figure 6A:
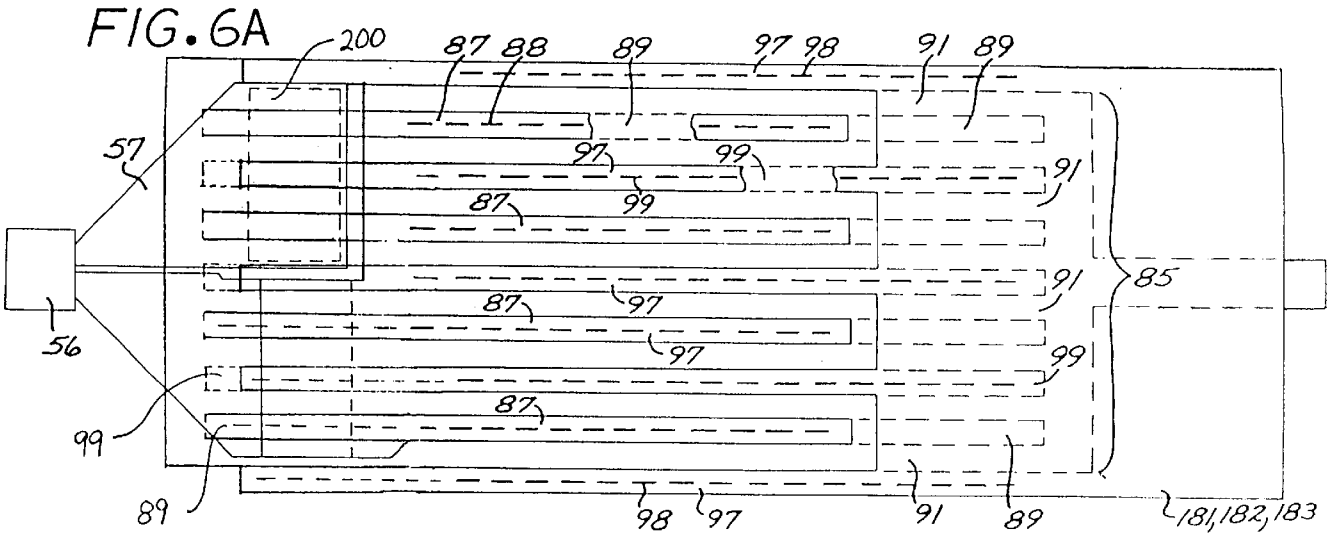
FIG. 6A is a plan view of representative FET drive circuits and the associated ground bus of the second embodiment of the printhead of FIG. 1.

The second embodiment of the present invention is illustrated in FIGS. 4A and 6A. As compared with the first embodiment shown in FIGS. 4 and 6, the width of the drive circuitry or transistor 85 is extended in a direction towards the resistors 56 or drop generators 61. In one embodiment, the transistor 85 is extended between the gold metallization layer 202 and the metal trace 57.

As shown in FIG. 6A, the transistor is moved towards the resistor such that the conductive via 200 is positioned at least partially over an area of the transistor. As compared with the first embodiment shown in FIG. 6, the distance between the conductive via and the resistor remains substantially the same in these two embodiments.

In one embodiment, the width of the polysilicon gate 91 is increased. In a particular embodiment, the increased gate width creates less heat and/or renders a smaller resistance over the whole transistor 85 as compared with the structure of FIG. 6.

In the embodiment shown in FIG. 6A, there are no contacts of the transistor 85 that extend under the conductive via 200. In the extended area of the transistor, there is a first area under the conductive via 200, and a second area. Contacts do not extend in the first area, and do extend in the second area, in this embodiment. In one embodiment, high transistor efficiency is attainable even without contacts in the first area.

In one embodiment, at least part of the drive circuitry (or transistor) of the heating element (or resistor) is positioned proximate to and within 60 microns of the heating element. Edges of the drive circuitry 85 is positioned in a range of 1 to 60 microns from edges of the heating element or resistor 56. In a particular embodiment, the drive circuitry is positioned between about 1 and 30 microns from the heating element. In a more particular embodiment, the drive circuitry is positioned about 5 microns from the heating element.

In one embodiment, as shown in FIG. 4A, each fluid heating resistor is arranged in a staggered fashion along the substrate. In this embodiment, the distance "d" between each resistor and its respective transistor remains in the range of from about 1 to about 60 microns. In another embodiment, the resistors are in a substantially straight row.

Figure 4B:
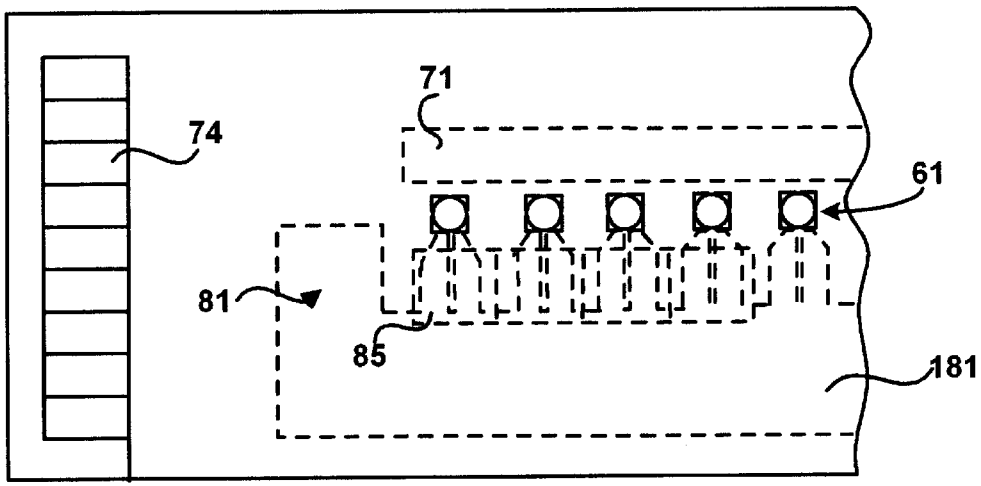
FIG. 4B is a partial top plan view generally illustrating a third embodiment the layout of an FET drive circuit array and an associated ground bus taken from section 4 of the printhead of FIG. 1.
Figure 6B:
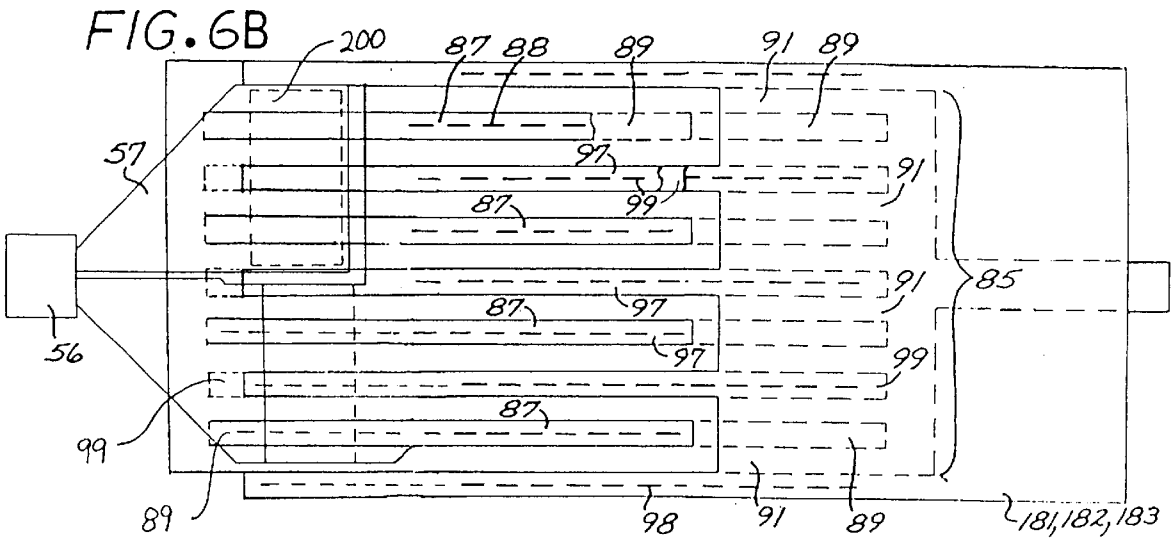
FIG. 6B is a plan view of representative FET drive circuits and the associated ground bus of the third embodiment of the printhead of FIG. 1.

The third embodiment of the present invention is illustrated in FIGS. 4B and 6B. The third embodiment is substantially similar to the second embodiment, except as described herein. As compared with the first embodiment shown in FIGS. 4 and 6, the drive circuitry or transistor 85 is shifted in a direction towards the resistors 56 or drop generators 61. In one embodiment, the width of the transistor 85 may increase. The distance between the edges of the ink drop generator and the transistor is the same as for the second embodiment described above. In one embodiment, the polysilicon gate is shifted towards the resistor.

As shown in FIG. 6B, the transistor is moved towards the resistor such that the conductive via 200 is positioned at least partially over an area of the transistor. As compared with the first embodiment shown in FIG. 6, the distance between the conductive via and the resistor remains substantially the same in each embodiment.

In the embodiment of FIG. 6B, the substrate or die 11 of the printhead is capable of being reduced in width substantially the same distance that the transistor 85 of the die is shifted towards its respective resistor. In another embodiment, the die is capable of being reduced substantially more in width when each of the transistors 85 of drive circuitry arrays 81, 82, 83 of FIG. 1 are shifted towards their respective resistors. Because the printhead die is a relatively expensive part of the printhead, saving material in the manufacture is a great cost savings.

Depending upon implementation, the heater resistors 56 of a particular ink drop generator group (61, 62, 63) can be arranged in a plurality of primitive groups, wherein the ink drop generators of a particular primitive are switchably coupled in parallel to the same ink firing primitive select signal, as for example disclosed in commonly assigned U.S. Pat. Nos. 5,604,519; 5,638,101; and 3,568,171, incorporated herein by reference. The source terminal of each of the FET drive circuits is electrically connected to an adjacent associated ground bus (181, 182, 183).

For ease of reference, the conductive traces including the conductive trace 86 and the ground bus that electrically connect a heater resistor 56 and an associated FET drive circuit 85 to bond pads 74 are collectively referred to as power traces. Also for ease of reference, the conductive traces 86 can be referred to as to the high side or non-grounded power traces.

Generally, the parasitic resistance (or on-resistance) of each of the FET drive circuits 85 is configured to compensate for the variation in the parasitic resistance presented to the different FET drive circuits 85 by the parasitic path formed by the power traces, so as to reduce the variation in the energy provided to the heater resistors. In particular, the power traces form a parasitic path that presents a parasitic resistance to the FET circuits that varies with location on the path, and the parasitic resistance of each of the FET drive circuits 85 is selected so that the combination of the parasitic resistance of each FET drive circuit 85 and the parasitic resistance of the power traces as presented to the FET drive circuit varies only slightly from one ink drop generator to another. Insofar as the heater resistors 56 are all of substantially the same resistance, the parasitic resistance of each FET drive circuit 85 is thus configured to compensate for the variation of the parasitic resistance of the associated power traces as presented to the different FET drive circuits 85. In this manner, to the extent that substantially equal energies are provided to the bond pads connected to the power traces, substantially equal energies can be provided to the different heater resistors 56.

Figure 7:
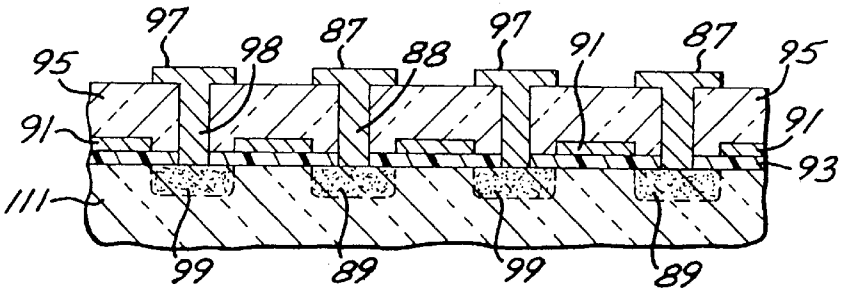
FIG. 7 is an elevational cross sectional view of a representative FET drive circuit of the printhead of FIG. 1.

Referring more particularly to FIGS. 6 and 7, each of the FET drive circuits 85 comprises a plurality of electrically interconnected drain electrode fingers 87 disposed over drain region fingers 89 formed in a silicon substrate 111, and a plurality of electrically interconnected source electrode fingers 97 interdigitated or interleaved with the drain electrodes 87 and disposed over source region fingers 99 formed in the silicon substrate 111. Polysilicon gate fingers 91 that are interconnected at respective ends are disposed on a thin gate oxide layer 93 formed on the silicon substrate 111. A phosphosilicate glass layer 95 separates the drain electrodes 87 and the source electrodes 97 from the silicon substrate 11. A plurality of conductive drain contacts 88 electrically connect the drain electrodes 87 to the drain regions 89, while a plurality of conductive source contacts 98 electrically connect the source electrodes 97 to the source regions 99. By way of illustrative example, the drain electrodes 87, drain regions 89, source electrodes 97, source regions 99, and the polysilicon gate fingers 91 extend substantially orthogonally or transversely to the reference axis L and to the longitudinal extent of the ground busses 181, 182, 183. Also, for each FET circuit 85, the extent of the drain regions 89 and the source regions 99 transversely to the reference axis L is the same as extent of the gate fingers transversely to the reference axis L, as shown in FIG. 6, which defines the extent of the active regions transversely to the reference axis L. For ease of reference, the extent of the drain electrode fingers 87, drain region fingers 89, source electrode fingers 97, source region fingers 99, and polysilicon gate fingers 91 can be referred to as the longitudinal extent of such elements insofar as such elements are long and narrow in a strip-like or finger-like manner.

By way of illustrative example, the on-resistance of each of the FET circuits 85 is individually configured by controlling the longitudinal extent or length of a continuously non-contacted segment of the drain region fingers, wherein a continuously non-contacted segment is devoid of electrical contacts 88. For example, the continuously non-contacted segments of the drain region fingers can begin at the ends of the drain regions 87 that are furthest from the heater resistor 56. The on-resistance of a particular FET circuit 85 increases with increasing length of the continuously non-contacted drain region finger segment, and such length is selected to determine the on-resistance of a particular FET circuit.

As another example, the on-resistance of each FET circuit 85 can be configured by selecting the size of the FET circuit. For example, the extent of an FET circuit transversely to the reference axis L can be selected to define the on-resistance.

For an implementation wherein the power traces for a particular FET circuit 85 are routed by reasonably direct paths to bond pads 74 on the closest of the longitudinally separated ends of the printhead structure, parasitic resistance increases with distance from the closest end of the printhead, and the on-resistance of the FET drive circuits 85 is decreased (making an FET circuit more efficient) with distance from such closest end, so as to offset the increase in power trace parasitic resistance. As a specific example, as to continuously non-contacted drain finger segments of the respective FET drive circuits 85 that start at the ends of the drain region fingers that are furthest from the heater resistors 56, the lengths of such segments are decreased with distance from the closest one of the longitudinally separated ends of the printhead structure.

Each ground bus (181, 182, 183) is formed of the same thin film conductive layer as the drain electrodes 87 and the source electrodes 97 of the FET circuits 85, and the active areas of each of the FET circuits comprised of the source and drain regions 89, 99 and the polysilicon gates 91 advantageously extend beneath an associated ground bus (181, 182, 183). This allows the ground bus and FET circuit arrays to occupy narrower regions, which in turn allows for a narrower, and thus less costly, thin film substructure.

Also, in an implementation wherein the continuously non-contacted segments of the drain region fingers start at the ends of the drain region fingers that are furthest from the heater resistors 56, the extent of each ground bus (181, 182, 183) transversely or laterally to the reference axis L and toward the associated heater resistors 56 can be increased as the length of the continuously non-contacted drain finger sections is increased, since the drain electrodes do not need to extend over such continuously non-contacted drain finger sections. In other words, the width W of a ground bus (181, 182, 183) can be increased by increasing the amount by which the ground bus overlies the active regions of the FET drive circuits 85, depending upon the length of the continuously non-contacted drain region segments. This is achieved without increasing the width of the region occupied by a ground bus (181, 182, 183) and its associated FET drive circuit array (81, 82, 83) since the increase is achieved by increasing the amount of overlap between the ground bus and the active regions of the FET drive circuits 85. Effectively, at any particular FET circuit 85, the ground bus can overlap the active region transversely to the reference axis L by substantially the length of the non-contacted segments of the drain regions.

Figure 8:
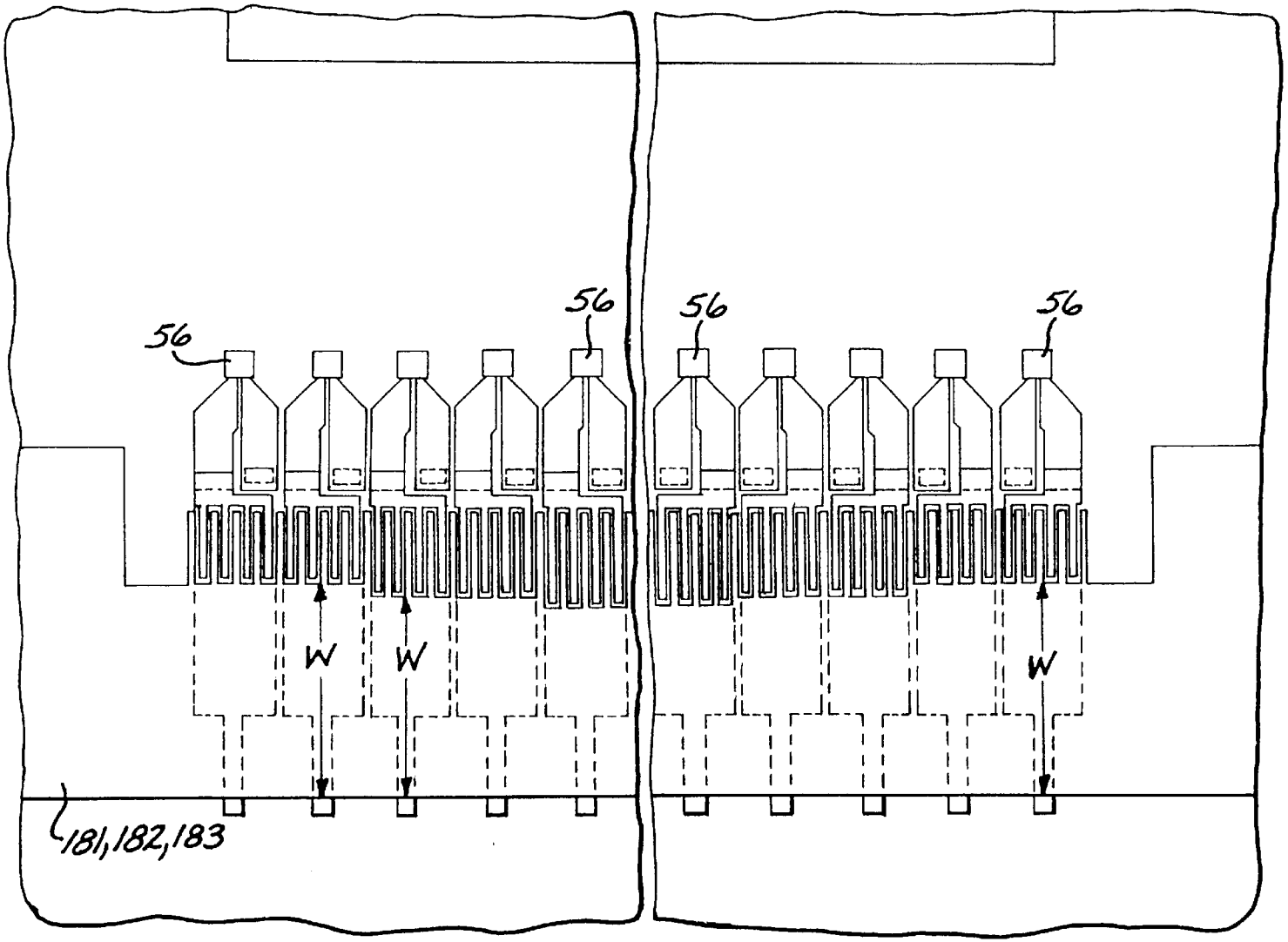
FIG. 8 is a plan view of plan view depicting an illustrative implementation of an FET drive circuit array and associated ground bus of the printhead of FIG. 1.

For the specific example wherein the continuously non-contacted drain region segments start at the ends of the drain region fingers that are furthest from the heater resistors 56 and wherein the lengths of such continuously non-contacted drain region segments decrease with distance from the closest end of the printhead structure, the modulation or variation of the width of a ground bus (181, 182, 183) with the variation of the length of the continuously non-contacted drain region segments provides for a ground bus having a width W that increases with proximity to the closest end of the printhead structure, as depicted in FIG. 8. Since the amount of shared currents increases with proximity to the bonds pads 74, such shape advantageously provides for decreased ground bus resistance with proximity to the bond pads 74.

While the foregoing has been directed to a printhead having three ink feed slots with ink drop generators disposed along only one side of an ink feed slot, it should be appreciated that the disclosed FET drive circuit array and ground bus structures can be implemented in variety of slot fed, edge fed, or combined slot and edge fed configurations. Also, ink drop generators can be disposed on one or both sides of an ink feed slot.

Figure 9:
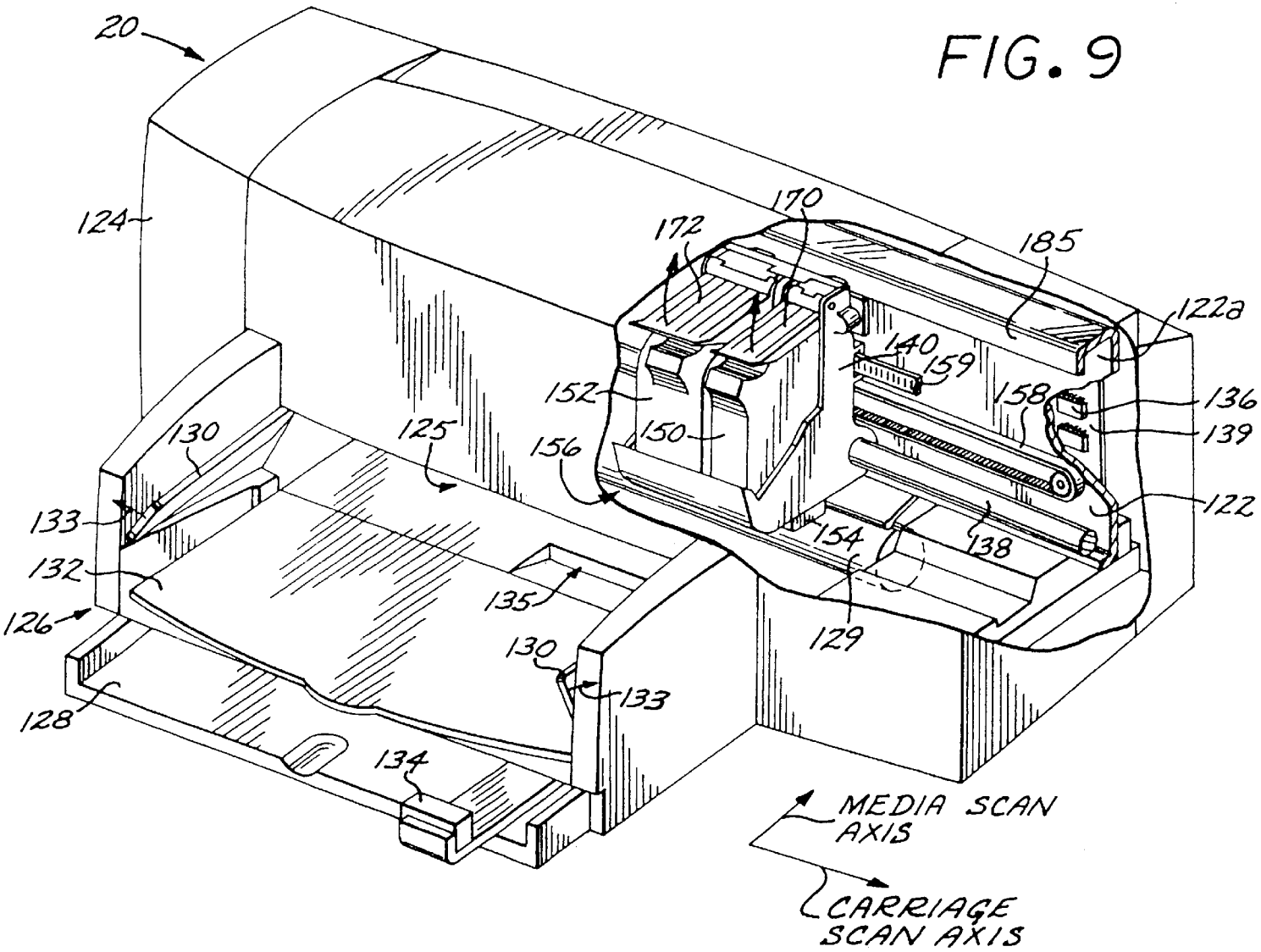
FIG. 9 is an unscaled schematic perspective view of a printer in which one embodiment of the printhead of the invention can be employed.

Referring now to FIG. 9, set forth therein is a schematic perspective view of an example of an ink jet printing device 20 in which the above-described printheads can be employed. The ink jet printing device 20 of FIG. 9 includes a chassis 122 surrounded by a housing or enclosure 124, typically of a molded plastic material. The chassis 122 is formed for example of sheet metal and includes a vertical panel 122*a*. Sheets of print media are individually fed through a print zone 125 by an adaptive print media handling system 126 that includes a feed tray 128 for storing print media before printing. The print media may be any type of suitable printable sheet material such as paper, card-stock, transparencies, Mylar, and the like, but for convenience the illustrated embodiments described as using paper as the print medium. A series of motor-driven rollers including a drive roller 129 driven by a stepper motor may be used to move print media from the feed tray 128 into the print zone 125. After printing, the drive roller 129 drives the printed sheet onto a pair of retractable output drying wing members 130 which are shown extended to receive a printed sheet. The wing members 130 hold the newly printed sheet for a short time above any previously printed sheets still drying in an output tray 132 before pivotally retracting to the sides, as shown by curved arrows 133, to drop the newly printed sheet into the output tray 132. The print media handling system may include a series of adjustment mechanisms for accommodating different sizes of print media, including letter, legal, A-4, envelopes, etc., such as a sliding length adjustment arm 134 and an envelope feed slot 135.

The printer of FIG. 9 further includes a printer controller 136, schematically illustrated as a microprocessor, disposed on a printed circuit board 139 supported on the rear side of the chassis vertical panel 122*a*. The printer controller 136 receives instructions from a host device such as a personal computer (not shown) and controls the operation of the printer including advance of print media through the print zone 125, movement of a print carriage 140, and application of signals to the ink drop generators 40.

A print carriage slider rod 138 having a longitudinal axis parallel to a carriage scan axis is supported by the chassis 122 to sizably support a print carriage 140 for reciprocating translational movement or scanning along the carriage scan axis. The print carriage 140 supports first and second removable ink jet printhead cartridges 150, 152 (each of which is sometimes called a "pen," "print cartridge," or "cartridge"). The print cartridges 150, 152 include respective printheads 154, 156 that respectively have generally downwardly facing nozzles for ejecting ink generally downwardly onto a portion of the print media that is in the print zone 125. The print cartridges 150, 152 are more particularly clamped in the print carriage 140 by a latch mechanism that includes clamping levers, latch members or lids 170, 172.

An illustrative example of a suitable print carriage is disclosed in commonly assigned U.S. application Ser. No. 08/757,009, filed Nov. 26, 1996, Harmon et al.

For reference, print media is advanced through the print zone 125 along a media axis which is parallel to the tangent to the portion of the print media that is beneath and traversed by the nozzles of the cartridges 150, 152. If the media axis and the carriage axis are located on the same plane, as shown in FIG. 9, they would be perpendicular to each other.

An anti-rotation mechanism on the back of the print carriage engages a horizontally disposed anti-pivot bar 185 that is formed integrally with the vertical panel 122*a* of the chassis 122, for example, to prevent forward pivoting of the print carriage 140 about the slider rod 138.

By way of illustrative example, the print cartridge 150 is a monochrome printing cartridge while the print cartridge 152 is a tri-color printing cartridge that employs a printhead in accordance with the teachings herein.

The print carriage 140 is driven along the slider rod 138 by an endless belt 158, and a linear encoder strip 159 is utilized to detect position of the print carriage 140 along the carriage scan axis.

Although the foregoing has been a description and illustration of specific embodiments of the invention, various modifications and changes thereto can be made by persons skilled in the art without departing from the scope and spirit of the invention as defined by the following claims.

What is claimed is:

1. A printhead comprising:

a firing chamber from which heated fluid is ejected;

a resistor that heats fluid in the firing chamber, the resistor formed in a substrate underlying the firing chamber; and a transistor electrically coupled with the resistor, the transistor also formed in the substrate;

wherein the transistor is positioned proximate to the resistor and at a distance within 60 microns thereof, and wherein the substrate has a width that corresponds to the distance between the resistor and the transistor.

2. The printhead of claim 1 wherein the transistor is positioned between about 1 and 30 microns from the resistor.

3. The printhead of claim 1 wherein the transistor is positioned about 5 microns from the resistor.

4. The printhead of claim 1 further comprising:

a via coupled to the resistor; and conductive traces coupled to the via, the conductive traces for routing firing signals to the resistor, wherein the via is positioned at least partially over an area of the transistor.

5. A printer component comprising:

a substrate;

a firing chamber from which heated fluid is ejected;

a heating element that heats fluid in the firing chamber;

drive circuitry for the heating element, the drive circuitry comprising drain electrodes coupled by conductive drain contacts to drain regions;

a conductive via electrically coupled with the heating element and positioned at least partially over an area of the drive circuitry, wherein the conductive drain contacts do not extend into the area of the drive circuit overlapped by the conductive via, forming a non-contacted segment of a drain region that is devoid of conductive drain contacts; and a ground bus coupled to the drive circuitry, wherein the ground bus has a length corresponding to the length of the non-contacted segment of the drain region.

6. The component of claim 5 wherein the drive circuitry is positioned within 60 microns of the heating element.

7. The component of claim 6 wherein the drive circuitry is positioned between about 1 and 30 microns from the heating element.

8. The component of claim 7 wherein the drive circuitry is positioned about 5 microns from the heating element.

9. A fluid ejection device comprising:

a firing chamber from which heated fluid is ejected;

a heating element that heats fluid in the firing chamber, the heating element formed in a substructure underlying the firing chamber; and drive circuitry for the heating element, the drive circuitry also formed in the substructure, wherein at least part of the drive circuitry is positioned at a distance within 60 microns of the heating element and wherein the substructure has a width that is selected according to the distance between the heating element and the drive circuitry.

10. The device of claim 9 further comprising:

a via coupled to the heating element; and conductive traces electrically coupled to the via, the conductive traces for routing firing signals to the heating element, wherein the via is positioned at least partially over an area of the drive circuitry.

11. The device of claim 9 wherein the drive circuitry is positioned between about 1 and 30 microns from the heating element.

12. A fluid ejection cartridge comprising:

a fluid chamber;

a substrate having a plurality of fluid firing chambers with a fluid heating resistor in each fluid firing chamber, wherein the fluid heating resistors are arranged along a top surface of the substrate, wherein the fluid firing chambers are positioned at a distance of less than 60 microns from respective drive circuitry for the fluid heating resistor and wherein the substrate has a width corresponding to the distance between the fluid firing chambers and the respective drive circuitry; and a fluid channel fluidically coupling the fluid chamber to the fluid firing chambers.

13. The cartridge of claim 12 wherein the fluid firing chambers are positioned between about 1 and 30 microns from the respective drive circuitry.

14. The cartridge of claim 13 wherein the fluid firing chambers are positioned about 5 microns from the drive circuitry.

15. The cartridge of claim 12 wherein the fluid heating resistors are arranged in a staggered fashion with respect to distances from the respective drive circuitry.

16. A method of manufacturing a fluid ejection device comprising:

forming a heating element within a firing chamber upon a first surface of a substrate;

positioning drive circuitry for the heating element in an area over the first surface, the drive circuitry comprising drain electrodes coupled by conductive drain contacts to drain regions;

electrically coupling a conductive via with the heating element;

positioning the conductive via at least partially over the area of the drive circuitry, wherein the conductive drain contacts do not extend into the area of the drive circuitry overlapped by the conductive via, forming a non-contacted segment of a drain region that is devoid of conductive drain contacts; and forming a ground bus that is coupled to the drive circuitry, wherein the ground bus has a length that corresponds to the length of the non-contacted segment of the drain region.

17. The method claim 16 wherein the heating element is positioned in a range of about 1 to 30 microns from the associated drive circuitry.

18. A method for fabricating a resistor-drive transistor architecture in a printing system, comprising:

positioning a plurality of fluid heating resistors on a substrate;

arranging a plurality of fluid firing chambers on the substrate that are associated with the plurality of fluid heating resistors; and positioning a plurality of drive transistors associated with the plurality of fluid heating resistors on the substrate, wherein each one of the plurality of drive transistors is at most a distance of 60 microns from a corresponding one of the plurality of fluid heating resistors to minimize resistance for the respective drive transistor and wherein the substrate has a width that corresponds to the distance between the drive transistors and the fluid heating resistors.

19. The method of claim 18 wherein the plurality of fluid heating resistors are arranged in a staggered fashion with respect to distances from respective drive transistors.

20. The method of claim 19 wherein each of the plurality of fluid heating resistors is distanced from their respective drive transistors in a range from about 1 micron to about 60 microns.

* * * * *